US006802701B2

(12) United States Patent
Noh et al.

(10) Patent No.: US 6,802,701 B2
(45) Date of Patent: Oct. 12, 2004

(54) SUCTION VALVE ASSEMBLY OF COMPRESSOR

(75) Inventors: Ki-Won Noh, Seoul (KR); Choong-Min Jung, Seongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/267,841

(22) Filed: Oct. 10, 2002

(65) Prior Publication Data

US 2003/0082063 A1 May 1, 2003

(30) Foreign Application Priority Data

Oct. 30, 2001 (KR) ..... 2001-67223

(51) Int. Cl.[7] ..... F04B 53/10

(52) U.S. Cl. ..... 417/552; 417/547; 417/555.1; 92/181 R; 92/181 P; 137/315.33; 137/533.27

(58) Field of Search ..... 417/545, 552, 417/547, 555.1; 92/181 R, 181 P; 137/315.33, 533.27

(56) References Cited

U.S. PATENT DOCUMENTS 307,862 A * 11/1884 Loth ..... 417/552
946,684 A * 1/1910 Neighbors ..... 137/315.33
1,293,936 A * 2/1919 Rose ..... 417/549
1,294,014 A * 2/1919 Worster ..... 137/533
1,808,745 A * 6/1931 Bledsoe et al. ..... 417/506
2,044,594 A * 6/1936 Scholfield ..... 417/236
2,701,581 A * 2/1955 Carlson et al. ..... 137/533.27
2,731,315 A * 1/1956 Church ..... 92/160

* cited by examiner

*Primary Examiner*—Justine R. Yu
*Assistant Examiner*—Emmanuel Sayoc
(74) *Attorney, Agent, or Firm*—Birch, Stewart, Kolasch & Birch, LLP

(57) ABSTRACT

A suction valve assembly of a compressor includes: a piston disposed movable in a cylinder forming a compression chamber, having a suction passage for sucking a fluid and a valve seat formed at a front side thereof; a valve body contacted to the valve seat to open and close the fluid, of which a front side making a portion of the compression chamber is formed hermetical; a support rod inserted into a rear portion of the valve body and fixed at one side of the piston and supporting the valve body to be moved in a certain range; and a release preventing unit formed between the valve body and the support rod to prevent the valve body from releasing from the support rod. A guide groove inside a compression chamber is removed to prevent generation of a dead volume, thereby improving an efficiency of a compressor.

10 Claims, 4 Drawing Sheets

SUCTION VALVE ASSEMBLY OF COMPRESSOR

This nonprovisional application claims priority under 35 U.S.C. §119(a) on Patent Application No. 2001-0067223 filed in KOREA on Oct. 30, 2001, which is herein incorporated by reference.

BACKGROUND OF THE INVENTION

1. Field of the Invention

The present invention relates to a suction valve assembly opened and closed by a fluid pressure, and more particularly, to a suction valve assembly of a compressor that is capable of preventing generation of a dead volume inside a compressor.

2. Description of the Background Art

In general, a suction valve assembly is installed between a compression chamber in which a fluid is compressed in a compressor or the like and a suction passage which sucks the fluid, so that, when the fluid is sucked, the suction valve assembly is opened by an inertia and supplies the fluid introduced through the suction passage to the compression chamber, and when the fluid is compressed, the suction valve assembly prevents the fluid being compressed in the compression chamber from flowing backward to the suction passage.

FIG. 1 is a partial sectional view of a compressor employing the suction valve assembly in accordance with a conventional art, and FIG. 2 is a view showing an operational state of the compressor employing the suction valve assembly in accordance with the conventional art.

The conventional compressor includes a cylinder fixedly disposed at a case (not shown) and forming a compression chamber 102, a piston 106 inserted into the cylinder 104 to be linearly and reciprocally movable to compress a fluid, and a suction valve assembly disposed at a front side of the piston 106 and opening and closing the fluid being sucked.

The piston 106 includes a suction passage 108 formed at the center thereof in a longitudinal direction to suck a fluid. A support portion 112 is formed at a front side of the piston 106, having a suction hole 110 to supply the fluid introduced into the suction passage 108 to the compression chamber 102. A valve seat 114 is formed at a front side of the support portion 112.

The suction valve assembly consists of a valve body 116 tightly adhered to the valve seat 114 and opened and closed, and a connection bolt 118 connected between the valve body 116 and the support portion 112 in order to prevent the valve body from releasing from the valve seat 114.

The valve body 116 is formed tapered with a certain angle at its outer circumferential surface and contacted to the valve seat 114, a through hole 120 is formed at the center thereof that the connection bolt 118 penetrates, and a guide groove 124 is formed with a diameter extended from the through hole 120 so that a bolt head 126 of the connection bolt 118 can be inserted to be linearly movable.

The connection bolt 118 passes the through hole 120 and bolt-engaged with the support portion 112, and the bolt head 126 of the connection bolt 118 is inserted into and linearly movable in the guide groove 124.

That is, when the valve body 116 is linearly moved and released from the valve seat 114, the bolt head of the connection bolt 118 is hooked at the inner side of the guide groove 124, so as to prevent the valve body 116 from releasing outwardly from the piston 106.

In the conventional suction valve assembly of a compressor constructed as described above, when the piston 106 is retreated by the operation of the driving unit (not shown) of the compressor to supply a fluid into the compression chamber 102, the valve body 116 is released from the valve seat 114 owing to the pressure of the fluid, so that the fluid introduced into the suction hole 110 of the piston is supplied to the compression chamber 102.

In this state, when the piston 106 is advanced for a compression operation of the fluid, the valve body 116 is tightly contacted to the valve seat 114 owing to the pressure of the fluid, whereby the fluid of the compression chamber 102 is prevented from flowing backward to the suction side.

However, the conventional suction valve assembly of a compressor has the following problems. That is, as described above, the guide groove with a certain volume is formed in the valve body so that the bolt head supporting the linear movement of the valve body can be linearly moved. In this respect, since the guide groove forms a portion of the compression chamber, the fluid of the compression chamber is introduced into the guide groove, when the fluid is compressed, to create a dead volume, which results in degradation of a compression efficiency.

In addition, when the fluid is compressed, in order to prevent the fluid from leaking into a gap between the through hole formed at the valve body and the connection bolt, a precision processing is required for sealing the parts. This causes a problem of increase in a fabrication cost.

SUMMARY OF THE INVENTION

Therefore, an object of the present invention is to provide a suction valve assembly of a compressor in which a guide groove inside a compression chamber is removed to prevent generation of a dead volume, thereby improving an efficiency of a compressor.

Another object of the present invention is to provide a suction valve assembly of a compressor in which a portion of a valve from which a fluid is leaked is removed to thereby reduce a fabrication cost and prevent degradation of a compression efficiency due to fluid leakage as a precision processing of a part for preventing the fluid leakage is not necessary.

To achieve these and other advantages and in accordance with the purpose of the present invention, as embodied and broadly described herein, there is provided a suction valve assembly of a compressor including: a piston disposed movable in a cylinder forming a compression chamber, having a suction passage for sucking a fluid and a valve seat formed at a front side thereof; a valve body contacted to the valve seat to open and close the fluid, of which a front side making a portion of the compression chamber is formed hermetical; a support rod inserted into a rear portion of the valve body and fixed at one side of the piston and supporting the valve body to be moved in a certain range; and a release preventing unit formed between the valve body and the support rod to prevent the valve body from releasing from the support rod.

In the suction valve assembly of a compressor of the present invention, the valve body of the suction valve assembly is formed tapered at its outer circumferential surface with a certain angle so as to be tightly adhered to the valve seat, and has a through hole formed at a rear side, into which the support rod is inserted, and a space part extended from the through hole and having a diameter larger than that of the through hole.

In the suction valve assembly of a compressor of the present invention, the support rod is formed integrally with the support portion formed at a front side of the piston.

In the suction valve assembly of a compressor of the present invention, the release preventing unit of the suction valve assembly includes a female screw formed at an inner circumferential face of an insertion groove of a valve body and a male screw formed at an end portion of the support rod and engaged with the female screw.

In the suction valve assembly of a compressor of the present invention, the space part of the valve body is formed with a certain gap so that an inner side of the space part and an upper face of the male screw of the support rod are not in contact with each other when the valve body is tightly adhered to the valve seat.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may exist a plurality of embodiments of a suction valve of a compressor in accordance with the present invention, of which the most preferred one will now be described.

Figure 1:
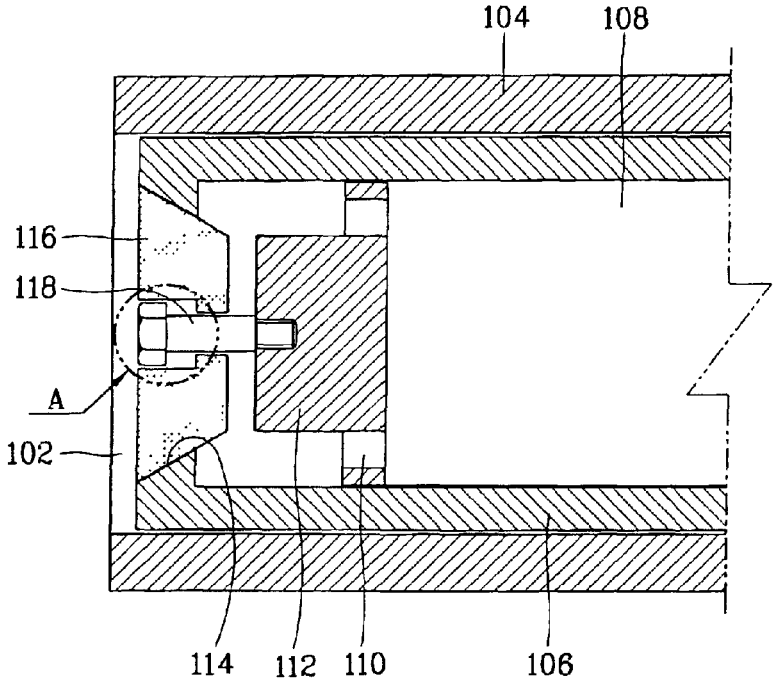
FIG. 1 CONVENTIONAL ART
FIG. 1 is a partial sectional view of a compressor adopting a suction valve assembly in accordance with a conventional art.
Figure 2:
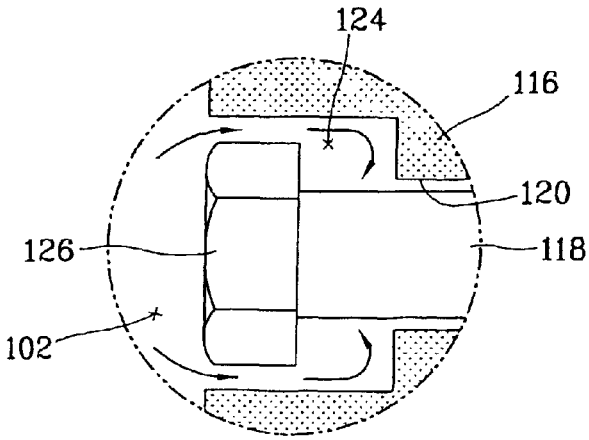
FIG. 2 CONVENTIONAL ART
FIG. 2 is an enlarged view of a portion 'A' of FIG. 1.
Figure 3:
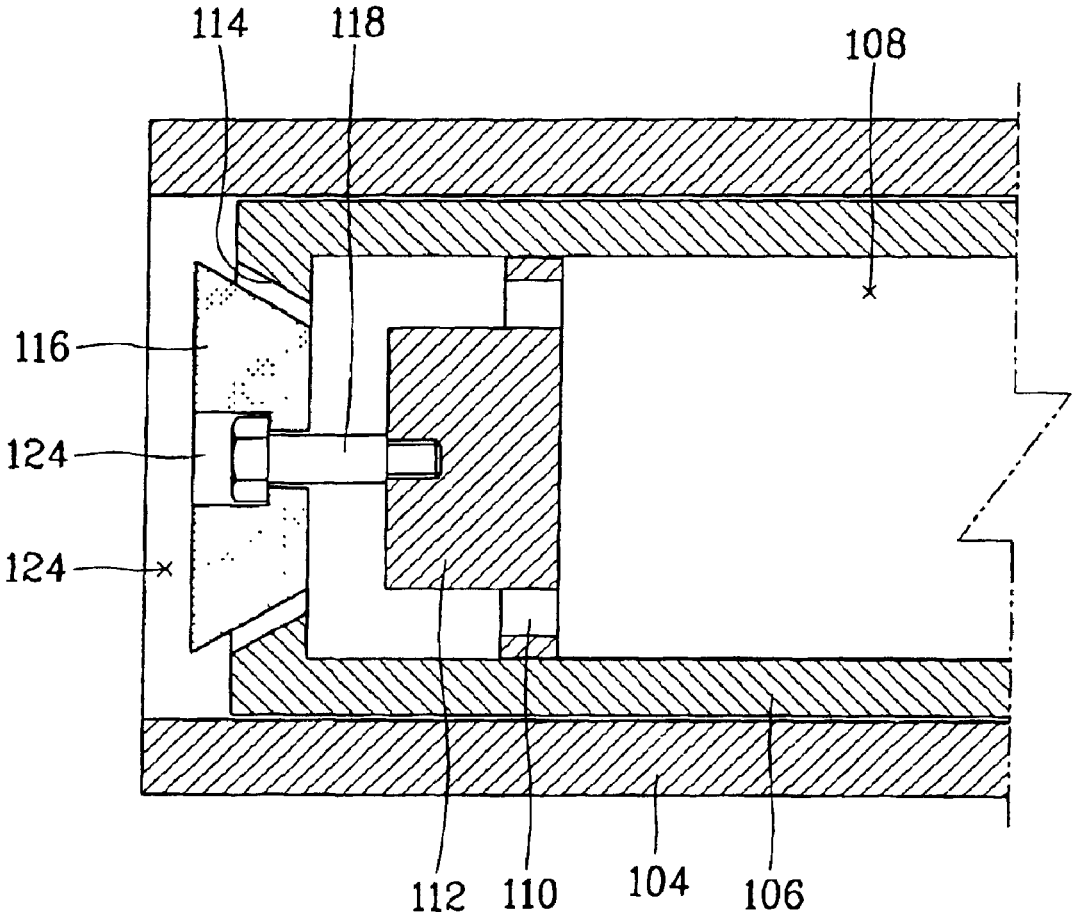
FIG. 3 CONVENTIONAL ART
FIG. 3 is a view showing a use state of a compressor adopting the suction valve assembly in accordance with the conventional art.
Figure 4:
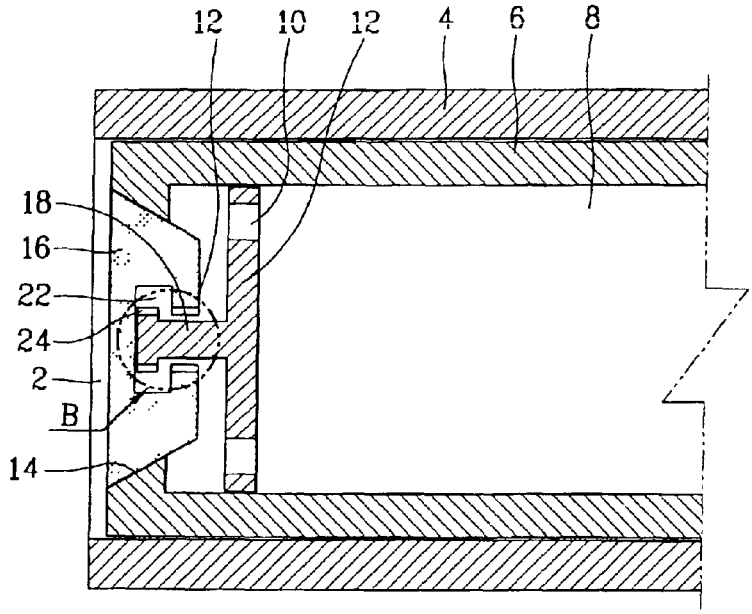
FIG. 4 is a partial sectional view of a compressor adopting a suction valve assembly in accordance with the present invention.
Figure 5:
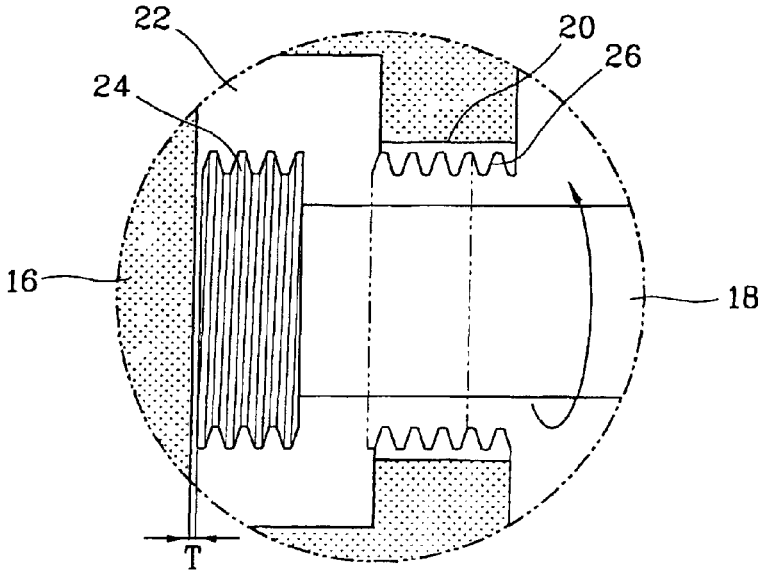
FIG. 5 is an enlarged view of a portion 'B' of FIG. 4.

FIG. 4 is a partial sectional view of a compressor adopting a suction valve assembly in accordance with the present invention, and FIG. 5 is an enlarged view of a portion 'B' of FIG. 4.

A compressor of the present invention includes a cylinder 4 fixed at a compressor case (not shown) and forming a compression chamber 2, a piston 6 disposed movable linearly and reciprocally inside the cylinder 4 to compress a fluid and forming a suction passage 8, and a suction valve assembly installed at a front side of the piston 6 and preventing a fluid from flowing backward from the compression chamber 2 to the suction passage 8.

The piston 6 is moved hermetically and reciprocally inside the cylinder 4, in which a suction passage 8 for sucking a fluid is formed in a longitudinal direction. A support portion 12, where a plurality of suction holes 10 through which the fluid sucked into the suction passage 8 is supplied to the compression chamber 2 are formed, is installed at a front side of the piston 6. A valve seat 14 is formed in a shape of hole tapered with a certain angle at a front side of the support portion 12.

The suction valve assembly consists of a valve body 16 contacted to the valve seat 14 to open and close the fluid; and a support rod 18 connected between the valve body 16 and the support portion 12 and supporting the valve body 16 so as to be moved in a certain range.

The valve body 16 is formed tapered in its outer circumferential surface so as to be tightly adhered to an inner circumferential surface of the valve seat 14, a front side of the valve body 16 forming the compression chamber together with the inner circumferential surface of the cylinder 4 is formed plane so as to prevent creation of a dead volume inside the compression chamber 2, a through hole 20 is formed at a rear side of the valve body 16, into which the support rod 18 passes, and a space part 22 is formed at the inner side of the through hole 20 in which the support rod 18 is moved in a certain range after being inserted.

One side of the support rod 18 is fixed at the support portion 12, and a release preventing unit is formed at the other end portion to prevent the support rod 18 from releasing from the space part 22 after being inserted into the through hole 20 of the valve body.

The support rod 18 is preferred to be molded integrally with the support portion 12 in a manner of being protruded forwardly of the support portion 12.

Otherwise, the support portion and the support rod may be fabricated separately and then mutually engaged with each other.

As for the release preventing unit, in order to prevent the support rod 18 from being released after being inserted into the through hole 20 of the valve body 16, a male screw 24 with a diameter larger than that of the support rod 18 is formed at an end portion of the support rod 18 and a female screw 26 to be spirally coupled with the male screw 24 is formed at an inner circumferential surface of the through hole 20.

That is, after the male screw 24 of the support rod 18 is spirally engaged with the female screw 26, the male screw 24 of the support rod 18 is movably positioned inside the space part 22 of the valve body. Then, when the valve body 16 is linearly moved, the male screw 24 is hooked at the inside of the space part 22 to thereby prevent release of the valve body 16.

Besides the structure of the release preventing unit constructed with the female screw and the male screw, any structure can be applied to the release preventing unit as long as it prevents the support rod from being released after being inserted into the space part 22.

As shown in FIG. 5, referring to the space part 22 of the valve seat, when the valve body 16 is tightly adhered to the valve seat 14, there is a gap between the valve seat 14 and the front side of the male screw 24, so that when the valve body 16 is moved, the inner circumferential surface of the space part 22 and the male screw 24 are not in contact with each other, to thereby prevent occurrence of a noise and vibration.

The operation of the suction valve assembly of a compressor of the present invention constructed as described above will now be explained.

Figure 6:
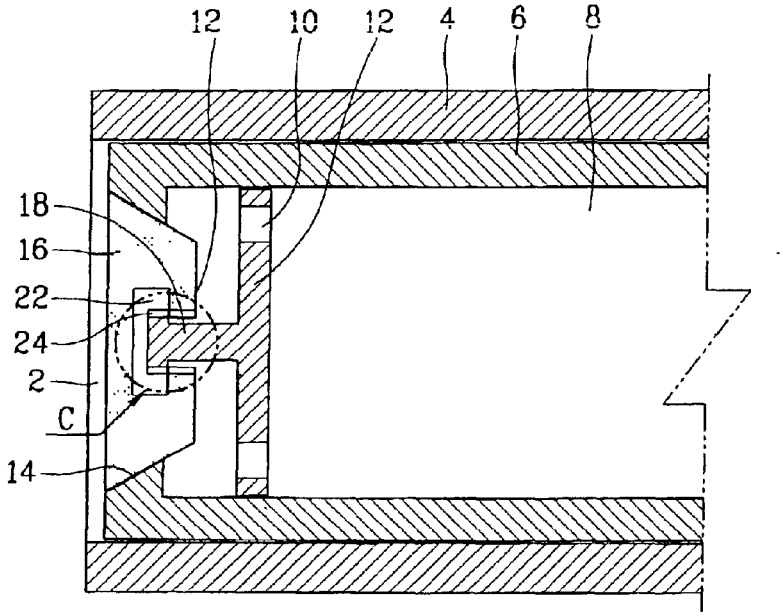
FIG. 6 is a view showing a use state of a compressor adopting the suction valve assembly in accordance with the present invention.
Figure 7:
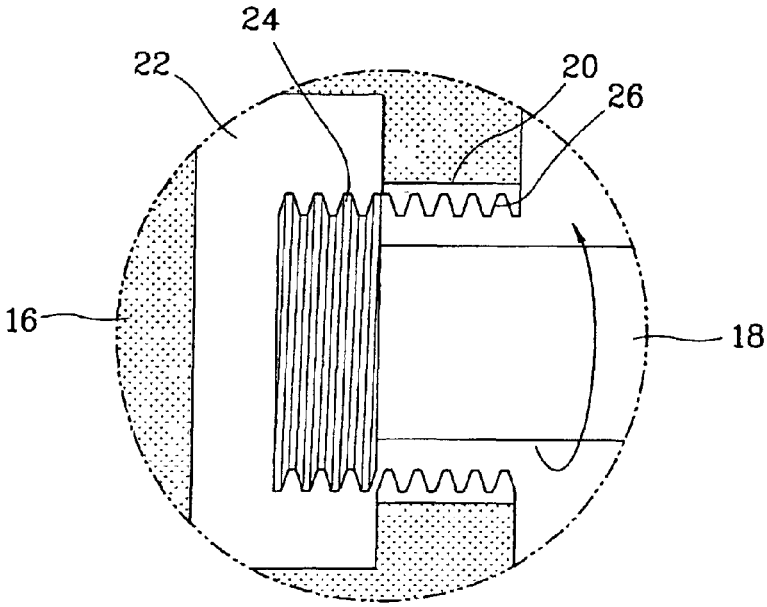
FIG. 7 is an enlarged view of a portion 'C' of FIG. 6.

FIG. 6 is a view showing a use state of a compressor adopting the suction valve assembly in accordance with the present invention, and FIG. 7 is an enlarged view of a portion 'C' of FIG. 6.

First, in case that a fluid of the suction passage 8 is supplied to the compression chamber 2, when the piston 6 is retreated according to an operation of a driving unit (not shown), the valve body 16 is released from the valve seat 14 due to an inertia according to the fluid flowing and the movement of the piston, so that the fluid introduced into the suction passage 8 is supplied to the compression chamber 2 through the suction hole 10.

At this time, the male screw 24 formed at the end portion of the support rod 18 is hooked in the space part 22 of the valve body 16, whereby the valve body 14 is prevented from being released from the piston 6.

In this state, when the piston 6 is advanced to compress the fluid, the valve body 16 is tightly adhered to the valve seat 14 owing to the inertia according to the advancing of the piston 6 and the pressure of the fluid filled in the compression chamber 2. Thus, the fluid of the compression chamber 2 can be prevented from flowing backward to the suction side.

In this respect, since the upper surface of the valve body 16, which makes a portion of the compression chamber 2, is formed plane, a dead volume can not be created inside the compression chamber 2, and thus, a compression efficiency of the fluid is increased.

At this time, when the valve body 16 and the valve seat 14 are tightly adhered to each other, the gap is maintained between the upper surface of the male screw 24 of the support rod 18 and the inner wall of the space part 22, so that a noise and vibration according to the contact between the male screw 24 and the inner circumferential face of the space part 22 when the valve body 16 is opened and closed can be prevented, and a tight adherence between the valve body 16 and the valve seat 14 can be maintained.

As so far described, the suction valve assembly of a compressor in accordance with the present invention has the following advantages.

That is, the upper surface, making the compression chamber of the valve body of the suction valve assembly is plane not to allow a dead volume to be created, so that a compression efficiency of the fluid can be improved.

In addition, since no fluid is leaked, a precision processing of parts for sealing a fluid is not necessary. Thus, a fabrication cost can be reduced and degradation of a compression efficiency due to a fluid leakage can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such metes and bounds are therefore intended to be embraced by the appended claims.

What is claimed is:

1. A suction valve assembly of a compressor comprising:

a piston disposed movably in a cylinder forming a compression chamber, said piston having a suction passage for sucking a fluid and a valve seat formed at a front side thereof;

a valve body contacted to the valve seat to open and close, said valve body being free of any passages which extend completely therethrough;

a support rod inserted into a rear portion of the valve body and fixed to a support portion at one side of the piston, wherein the rod is permitted a limited range of axial movement with respect to the valve body during operation, and wherein the rod facilitates movement of the valve body within a certain range; and a release preventing unit formed between the valve body and the support rod to prevent the valve body from releasing from the support rod.

2. The assembly of claim 1, wherein the valve body is formed tapered at its outer circumferential surface with a certain angle so as to be tightly adhered to the valve seat, and has a through-hole formed at a rear side, into which the support rod is inserted, and a space part extended from the through-hole and having a diameter larger than the diameter of the through-hole.

3. The assembly of claim 1, wherein the support rod is formed integrally with the support portion, said support portion being formed at a front side of the piston.

4. A suction valve assembly of a compressor comprising:

a piston disposed movably in a cylinder forming a compression chamber, said piston having a suction passage for sucking a fluid and a valve set formed at a front side thereof;

a valve body contacted to the valve seat to open and close, a front side of said valve body having a surface common with the compression chamber, wherein the valve body is formed tapered at its outer circumferential surface with a certain angle so as to be tightly adhered to the valve seat, and has a through-hole formed at a rear side, into which the support rod is inserted, and a space part extended from the through-hole and having a diameter larger than the diameter of the through-hole;

a support rod inserted into a rear portion of the valve body and fixed to a support portion at one side of the piston an facilitating movement of the valve body within a certain range; and a release preventing unit formed between the valve body and the support rod to prevent the valve body from releasing from the support, wherein the release preventing unit includes a female screw formed at an inner circumferential face of the through-hole of the valve body and a male screw formed at an end portion of the support rod and threaded with the female screw.

5. The assembly of claim 4, wherein the space part of the valve body is formed with a certain gap so that an inner side of the space part and an upper face of the male screw of the support rod are not in contact with each other when the valve body is tightly adhered to the valve seat.

6. The assembly of claim 1, wherein said front side of said valve body is flat.

7. The assembly of claim 1, wherein said front side of said valve body is flat and un-interrupted.

8. A suction valve assembly of a compressor comprising:

a piston disposed movably in a cylinder forming a compression chamber, said piston having a suction passage for sucking a fluid and a valve seat formed at a front side thereof;

a valve body contacted to the valve seat to open and close, a front side of said valve body having a surface common with the compression chamber, said front side of said valve body being substantially flat and uninterrupted so as to minimize a dead volume in said compression chamber;

a support rod inserted into a rear portion of the valve body and fixed to a support portion at one side of the piston, wherein the rod is permitted a limited range of axial movement with respect to the valve body during operation, and wherein the rod facilitates movement of the valve body within a certain range; and a release preventing unit formed between the valve body and the support rod to prevent the valve body from releasing from the support rod.

9. The assembly of claim 8, wherein the valve body is formed tapered at its outer circumferential surface with a certain angle so as to be tightly adhered to the valve seat, and has a through-hole formed at a rear side, into which the support rod is inserted, and a space part extended from the through-hole and having a diameter larger than the diameter of the through-hole.

10. The assembly of claim 8, wherein the support rod is formed integrally with the support portion said support portion being formed at a front side of the piston.

* * * * *